US008698586B2

(12) United States Patent
Park et al.

(10) Patent No.: US 8,698,586 B2
(45) Date of Patent: Apr. 15, 2014

(54) TRANSFORMER AND FLAT PANEL DISPLAY DEVICE INCLUDING THE SAME

(75) Inventors: Geun Young Park, Gyunggi-do (KR); Myeong Sik Cheon, Gyunggi-do (KR); Jae Gen Eom, Gyunggi-do (KR); Sang Joon Seo, Gyunggi-do (KR); Deuk Hoon Kim, Gyunggi-do (KR); Hwi Beom Shin, Gyeongsangnam-do (KR); Young Min Lee, Gyunggi-do (KR); Jong Hae Kim, Gyunggi-do (KR)

(73) Assignee: Samsung Electro-Mechanics Co., Ltd., Suwon, Gyunggi-Do (KR)

( * ) Notice: Subject to any disclaimer, the term of this patent is extended or adjusted under 35 U.S.C. 154(b) by 0 days.

(21) Appl. No.: 13/175,632

(22) Filed: Jul. 1, 2011

(65) Prior Publication Data

US 2012/0002387 A1 Jan. 5, 2012

(30) Foreign Application Priority Data

Jul. 2, 2010 (KR) ..... 10-2010-0063720
Dec. 29, 2010 (KR) ..... 10-2010-0138345
Jun. 14, 2011 (KR) ..... 10-2011-0057274

(51) Int. Cl.
*H01F 27/29* (2006.01)

(52) U.S. Cl.
USPC ..... 336/192

(58) Field of Classification Search
USPC ..... 336/198, 200, 232, 192
See application file for complete search history.

(56) References Cited

U.S. PATENT DOCUMENTS 3,652,968 A * 3/1972 Johnston et al. ..... 336/170
3,946,350 A 3/1976 Goto
3,958,328 A * 5/1976 Lee ..... 29/605
4,250,479 A 2/1981 Bausch et al.
4,596,974 A * 6/1986 Tobben et al. ..... 336/197

(Continued)

FOREIGN PATENT DOCUMENTS

CN 1497296 A 5/2004
CN 1514424 A 7/2004

(Continued)

OTHER PUBLICATIONS

Japanese Office Action and English Translation for Application No. 2011-147753 dated May 7, 2013.

(Continued)

*Primary Examiner* — Tuyen Nguyen
(74) *Attorney, Agent, or Firm* — McDermott Will & Emery LLP

(57) ABSTRACT

There are provided a thin transformer capable of being used in a thin display device such as a liquid crystal display (LCD) device, a light emitting diode (LED) device, and a flat panel display device including the thin transformer. The transformer includes a bobbin part including inner and outer bobbins each including a pipe shaped body part having a though-hole formed in an inner portion thereof and a flange part protruding outwardly from both ends of the body part; coils respectively wound around the inner and outer bobbins; and a core electromagnetically coupled to the coils to thereby form a magnetic path, wherein the outer bobbin includes a support part formed at the flange part formed at an upper end of the body part of the outer bobbin so as to cover a portion of the through-hole, and the inner bobbin is coupled to the outer bobbin while having one end supported by the support part.

26 Claims, 8 Drawing Sheets

(56) References Cited

U.S. PATENT DOCUMENTS

| | | | | | |
|---|---|---|---|---|---|
| 4,857,878 | A | * | 8/1989 | Eng et al. | 336/192 |
| 4,967,121 | A | * | 10/1990 | Nero | 315/411 |
| 5,534,839 | A | | 7/1996 | Mackin et al. | |
| 5,673,013 | A | | 9/1997 | Moody et al. | |
| 5,726,616 | A | | 3/1998 | Bell | |
| 5,996,214 | A | | 12/1999 | Bell | |
| 6,127,912 | A | | 10/2000 | Dust et al. | |
| 6,344,786 | B1 | | 2/2002 | Chin | |
| 6,611,189 | B2 | | 8/2003 | Sigl | |
| 6,900,717 | B2 | | 5/2005 | Timashov et al. | |
| 8,018,314 | B2 | | 9/2011 | Zeng et al. | |
| 2003/0030531 | A1 | | 2/2003 | Okano et al. | |
| 2004/0125065 | A1 | | 7/2004 | Park et al. | |
| 2004/0224598 | A1 | | 11/2004 | Tanaka | |
| 2005/0275498 | A1 | | 12/2005 | Haga | |
| 2006/0255898 | A1 | | 11/2006 | Sawazaki et al. | |
| 2007/0273466 | A1 | | 11/2007 | Yang et al. | |
| 2008/0180205 | A1 | | 7/2008 | Tsai et al. | |
| 2009/0237195 | A1 | | 9/2009 | Zeng et al. | |

FOREIGN PATENT DOCUMENTS

| | | | |
|---|---|---|---|
| GB | 2112746 | A | 7/1983 |
| JP | 61-140515 | | 8/1986 |
| JP | 62005622 | A | 1/1987 |
| JP | 63-170915 | | 11/1988 |
| JP | 1156523 | U | 10/1989 |
| JP | 03284807 | A | 12/1991 |
| JP | 05-038845 | | 2/1993 |
| JP | 5-66935 | | 9/1993 |
| JP | 5-66935 | U | 9/1993 |
| JP | 05283248 | A | 10/1993 |
| JP | 5-304033 | A | 11/1993 |
| JP | 5-90928 | | 12/1993 |
| JP | 5-90928 | A | 12/1993 |
| JP | 06-013124 | | 1/1994 |
| JP | 6-112058 | A | 4/1994 |
| JP | 6-112058 | A | 4/1994 |
| JP | 06-295828 | | 10/1994 |
| JP | 7-022526 | A | 1/1995 |
| JP | 07-106158 | A | 4/1995 |
| JP | 08-069928 | | 3/1996 |
| JP | 08-69928 | A | 3/1996 |
| JP | 08-153630 | | 6/1996 |
| JP | 08-153630 | U | 6/1996 |
| JP | 09-129457 | | 5/1997 |
| JP | 2569842 | Y2 | 2/1998 |
| JP | 2001-350133 | A | 6/2000 |
| JP | 2001-250728 | | 9/2001 |
| JP | 2001-305972 | | 11/2001 |
| JP | 2001-305972 | A | 11/2001 |
| JP | 2001-350133 | A | 12/2001 |
| JP | 2002-313641 | A | 10/2002 |
| JP | 3454801 | B2 | 7/2003 |
| JP | 2005-158927 | | 6/2005 |
| JP | 2009-117660 | | 5/2009 |
| KR | 10-2006-0035561 | A | 4/2006 |

OTHER PUBLICATIONS

Japanese Office Action for Patent Application No. 2011-147692 and English abstract dated Mar. 5, 2013.

Japanese Office Action for Patent Application No. 2011-147586 and English abstract dated Mar. 5, 2013.

United States Office Action issued in U.S. Appl. No. 13/175,438 dated Aug. 16, 2012.

Korean Office Action, w/ English translation thereof, issued in Korean Patent Application No. 10-2011-0057274, dated Sep. 19, 2011.

United States Office Action issued in U.S. Appl. No. 13/175,678 mailed Feb. 25, 2013.

United States Office Action issued in U.S. Appl. No. 13/175,438 mailed on Feb. 19, 2013.

United States Office Action issued in U.S. Appl. No. 13/175,640 mailed on Jan. 30, 2013.

United States Office Action issued in U.S. Appl. No. 13/175,290 mailed on Feb. 14, 2013.

U.S. Office Action issued in U.S. Appl. No. 13/175,660, mailed Oct. 16, 2012.

US Office Action issued in U.S. Appl. No. 13/175,471 dated Oct. 9, 2012.

Japanese Office Action issued in Japanese Patent Application No. 2011-147692 dated Jun. 5, 2012.

Chinese Office Action, w/ English translation thereof, issued in Chinese Patent Application No. CN 201110191334.8 dated Oct. 12, 2013.

Office Action issued in Japanese Patent Application No. 2011-147753 dated May 7, 2013.

Office Action issued in U.S. Appl. No. 13/175,438 dated Jun. 6, 2013.

Chinese Office Action with English translation issued in Chinese Application No. 201110191452.9 dated Oct. 8, 2013.

* cited by examiner

TRANSFORMER AND FLAT PANEL DISPLAY DEVICE INCLUDING THE SAME

CROSS-REFERENCE TO RELATED APPLICATIONS

This application claims the priority of Korean Patent Application Nos. 10-2010-0063720 filed on Jul. 2, 2010, 10-2010-0138345 filed on Dec. 29, 2010, and 10-2011-0057274 filed on Jun. 14, 2011, in the Korean Intellectual Property Office, the disclosure of which is incorporated herein by reference.

BACKGROUND OF THE INVENTION

1. Field of the Invention

The present invention relates to a thin transformer capable of being used in a thin display device such as a liquid crystal display (LCD) device, a light emitting display (LED) device, and a flat panel display device including the same.

2. Description of the Related Art

Recently, a flat panel display (FPD) which is a new technology appropriate for a multi-media system having a high resolution and a large-sized screen, or the like, has been prominent in the field of displays, instead of a cathode ray tube (CRT).

Particularly, a thin display such as a liquid crystal display (LCD) television (TV) or a plasma display panel (PDP) TV has been spotlighted in a large-sized display. In the future, it is expected that the thin display will be popular in view of cost and marketability.

A cold cathode fluorescent lamp (CCFL) has been used as a backlight light source in LCD TVs. However, the use of a light emitting diode (LED) has recently been increased due to relatively reduced power consumption, prolonged lifespan, environmental friendliness, and the like.

In accordance with the use of the LED, a backlight unit has been miniaturized. As a result, a thickness of a flatscreen TV has gradually been reduced. In addition, the demand for the slimness of a power supply module within the flatscreen TV has been increased.

In the case of the transformer according to the related art, a coil is generally wound perpendicularly to a printed circuit board. In addition, the core is provided in a form in which it forms a magnetic path in parallel with the printed circuit board. Therefore, a magnetic path of a majority of the leakage magnetic flux of the transformer is formed through a space between a back cover and the transformer (or a space between the printed circuit board and the transformer).

Accordingly, in the case of the transformer according to the related art, since the leakage magnetic flux is distributed over the space between the back cover and the transformer, when the back cover and the transformer have a narrow interval therebetween in order to obtain the slimness of a display device, interference is generated between the back cover formed of a metallic material and the leakage magnetic flux, such that noise is generated while the back cover is vibrated.

In addition, it requires significant manpower to produce a transformer according to the related art. That is, since most of a production process is manually performed, there is a limitation in increasing productivity or securing reliability of a product.

SUMMARY OF THE INVENTION

An aspect of the present invention provides a thin transformer capable of being easily used in a thin display device, or the like, and a flat panel display device including the same.

Another aspect of the present invention provides a transformer capable of being automatically produced, and a flat panel display device including the same.

Another aspect of the present invention provides a transformer having a structure in which individual bobbins may easily be coupled to each other such that automatic production thereof is easily performed, and a flat panel display device including the same.

According to an aspect of the present invention, there is provided a transformer including: a bobbin part including inner and outer bobbins each including a pipe shaped body part having a through-hole formed in an inner portion thereof and a flange part protruding outwardly from both ends of the body part; coils respectively wound around the inner and outer bobbins; and a core electromagnetically coupled to the coils to thereby form a magnetic path, wherein the outer bobbin includes a support part formed at the flange part formed at an upper end of the body part of the outer bobbin so as to cover a portion of the through-hole, and the inner bobbin is coupled to the outer bobbin while having one end supported by the support part.

The through-hole in an upper end portion of the outer bobbin may have a cross-sectional area different from that of the through-hole in a lower end portion of the outer bobbin, due to the support part.

The inner bobbin may include at least one fitting protrusion protruding from an upper surface of the flange part formed at the upper end of the body part thereof.

The outer bobbin may include at least one fitting hole formed in the support part, and the inner bobbin may be coupled to the outer bobbin while having the fitting protrusion inserted into the fitting hole.

The fitting protrusion may be forcedly fitted into the fitting hole, such that the inner bobbin is fixedly coupled to the outer bobbin.

An inner surface of the flange part of the inner bobbin and an inner surface of the flange part of the outer bobbin may be disposed on the same plane.

At least one of an upper surface of the flange part of the inner bobbin and a lower surface of the support part of the outer bobbin may include at least one fitting protrusion protruding therefrom, and the other thereof may include a fitting groove formed to correspond the fitting protrusion and having the fitting protrusion fitted thereinto.

Each of the inner and outer bobbins may include external connection terminals connected to one end of a lower flange part formed at a lower end of the body part thereof.

The inner and outer bobbins may be coupled to each other such that the external connection terminals of the inner bobbin and the external connection terminals of the outer bobbin are disposed in opposing directions.

The external connection terminals of the inner bobbin may support the outer bobbin while having an upper surface contacting a lower surface of the lower flange part of the outer bobbin.

The outer bobbin may include an extension part extended outwardly from the other end of the lower flange part contacting the external connection terminals of the inner bobbin, and allowing for an increase in an area of the lower flange part.

The outer bobbin may include a coil skip part, which is a route through which lead wires of the coil wound around the body part are skipped to a lower surface of the flange part through an outer peripheral edge of the flange part and connected to the external connection terminals.

The coil skip part may include: a skip groove, which is a route through which the lead wires of the coil wound around the body part are transferred to the lower surface of the flange part; and a traversing route, which is a route disposed such that the lead wires skipped through the skip groove traverse the lower surface of the flange part.

The outer bobbin may include a terminal connection part protruding outwardly from one end of the lower flange part formed on the lower end of the body part thereof and having the external connection terminals connected thereto.

The coil skip part may be a route formed between the terminal connection part and a guide block protruding from the lower surface of the lower flange part in parallel with the terminal connection part.

The guide block may have one end protruding outwardly from an outer peripheral edge of the lower flange part, and the skip groove is a groove formed by the one end of the guide block, the terminal connection part, and the lower flange part. The terminal connection part may include a plurality of lead grooves formed between the external connection terminals, and the lead wires may be provided in plural and connected to the external connection terminals while passing through the skip groove or the lead groove.

The coil skip part may further include at least one guide groove formed to have a groove shape in a lower surface of the terminal connection part to thereby allow a direction of lead wires disposed in the traversing route to be changed to a direction in which the external connection terminals are disposed.

The guide groove may include a plurality of guide grooves divided by a plurality partition walls, and at least one of the plurality of partition walls may have one end protruding into the traversing route.

The partition walls may have different protrusion distances protruding into the traversing route.

The partition walls may have protrusion distances protruding into the traversing path that become smaller as the partition walls are disposed to be adjacent to the skip groove.

The partition walls may include chamfers formed at edge parts thereof contacting the lead wires.

The partition walls may make a right angle or an acute angle with a bottom surface thereof at edge parts thereof contacting the lead wires.

According to another aspect of the present invention, there is provided a transformer including: an outer bobbin including a pipe shaped body part having a through-hole formed in an inner portion thereof and a support part formed at any one end of the body part so as to cover a portion of the through-hole; and an inner bobbin inserted into the through-hole of the outer bobbin to be thereby coupled to the outer bobbin while being in contact with the support part.

At least one of an inner surface of the support part of the outer bobbin and an outer surface of one end of the inner bobbin may include at least one fitting protrusion protruding therefrom, and the other thereof may include a fitting groove formed to correspond the fitting protrusion and having the fitting protrusion fitted thereinto.

According to another aspect of the present invention, there is provided a transformer including: a bobbin part including a plurality of bobbins each including a pipe shaped body part having a though-hole formed in an inner portion thereof and a flange part protruding outwardly from both ends of the body part; external connection terminals connected to one end of at least of the flange part; and at least one coil wound around a space formed by an outer peripheral surface of the body part and one surface of the flange part, wherein lead wires of the coil are connected to the external connection terminals while being separately disposed on one surface and the other surface of the flange part in order to prevent an intersection therebetween.

The bobbin part may include: an outer bobbin including a support part formed at any one end of the body part so as to cover a portion of the through-hole; and an inner bobbin inserted into the through-hole of the outer bobbin and coupled to the outer bobbin while having one end surface-contacting the support part.

According to another aspect of the present invention, there is provided a flat panel display device including: a switching mode power supply including at least one transformer of any one of claims 1 to 27 mounted on a substrate thereof; a display panel receiving power from the switching mode power supply; and a cover protecting the display panel and the switching mode power supply.

The coils of the transformer may be wound so as to be parallel to the substrate of the switching mode power supply.

The substrate of the switching mode power supply may include a through-hole shaped reception part formed therein, and the transformer may be received in the reception part and mounted on the substrate.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE INVENTION

Figure 1:
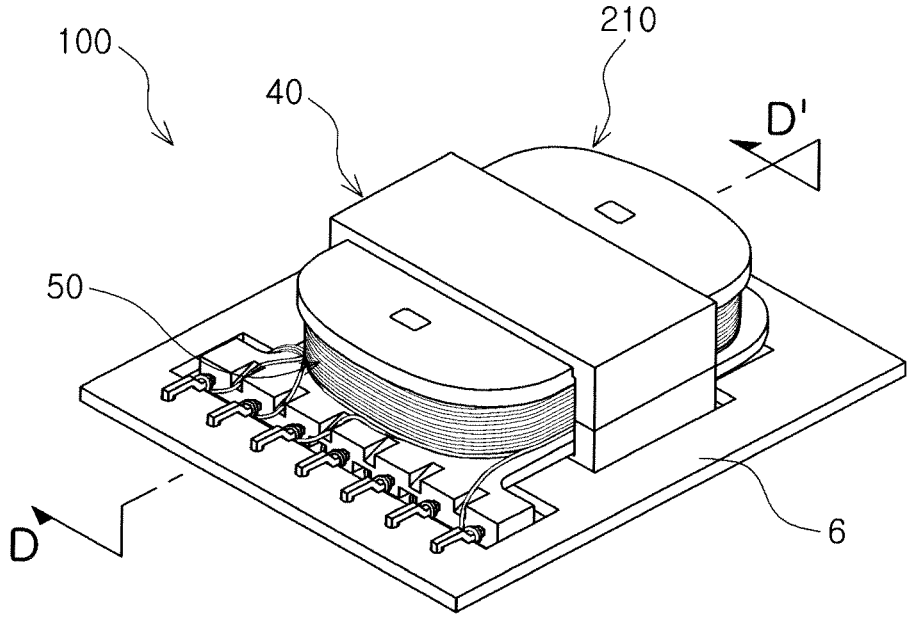
FIG. 1 is a perspective view schematically showing a transformer according to an embodiment of the present invention.

The terms and words used in the present specification and claims should not be interpreted as being limited to typical meanings or dictionary definitions, but should be interpreted as having meanings and concepts relevant to the technical scope of the present invention based on the rule according to which an inventor can appropriately define the concept of the term to most appropriately describe the best method he or she knows for carrying out the invention. Therefore, the configurations described in the embodiments and drawings of the present invention are merely the most preferable embodiments but do not represent all of the technical spirit of the present invention. Thus, the present invention should be construed as including all the changes, equivalents, and substitutions included in the spirit and scope of the present invention at the time of filing this application.

Hereinafter, embodiments of the present invention will be described in detail with reference to the accompanying drawings. At this time, it is noted that like reference numerals denote like elements in appreciating the drawings. Moreover, detailed descriptions related to well-known functions or configurations will be ruled out in order not to unnecessarily obscure the subject matter of the present invention. Based on the same reason, it is to be noted that some components shown in the drawings are exaggerated, omitted or schematically illustrated, and the size of each component does not exactly reflect its real size.

Hereinafter, embodiments of the present invention will be described in detail with reference to the accompanying drawings.

Figure 2:
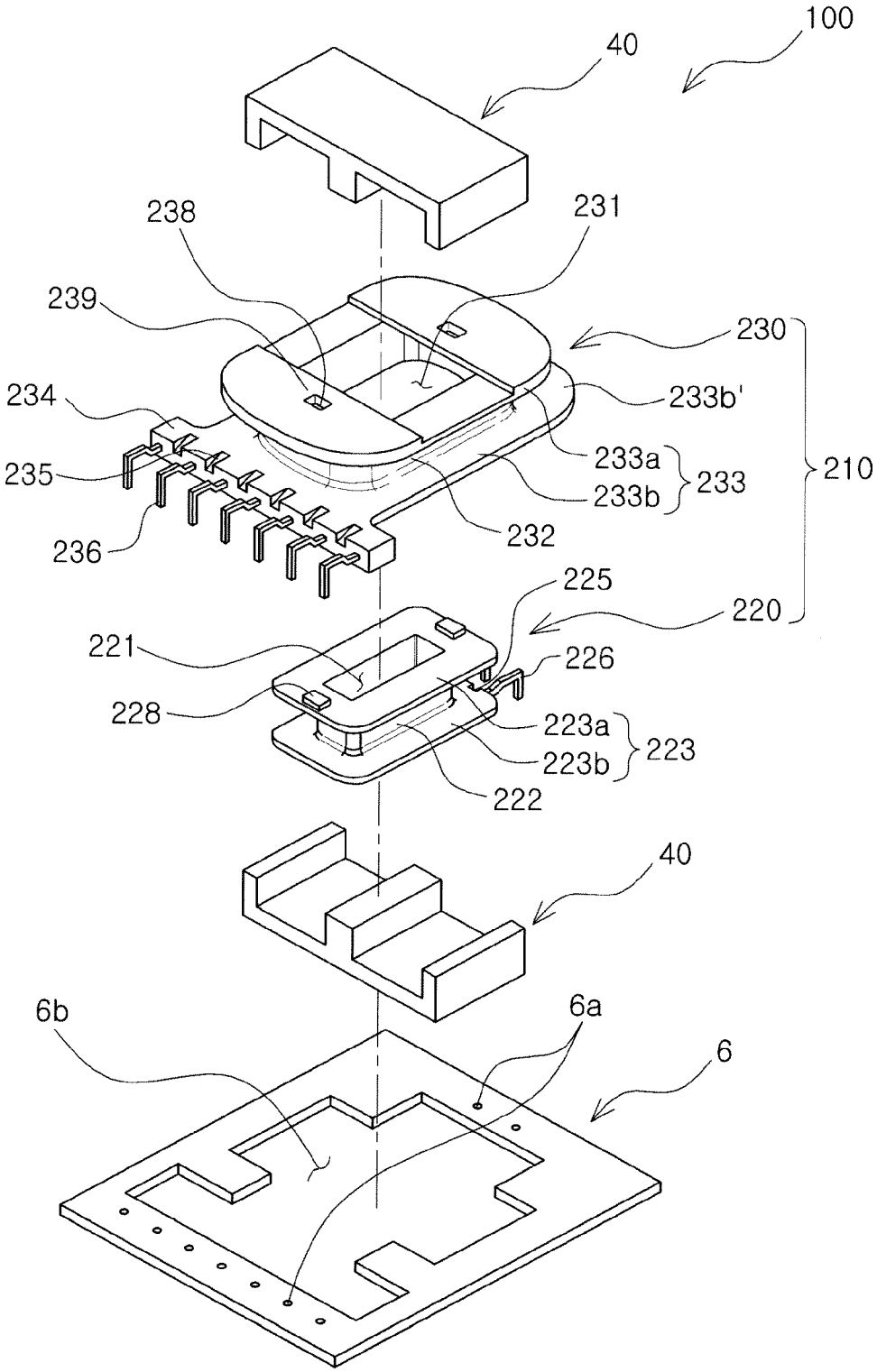
FIG. 2 is an exploded perspective view of the transformer shown in FIG. 1.
Figure 3:
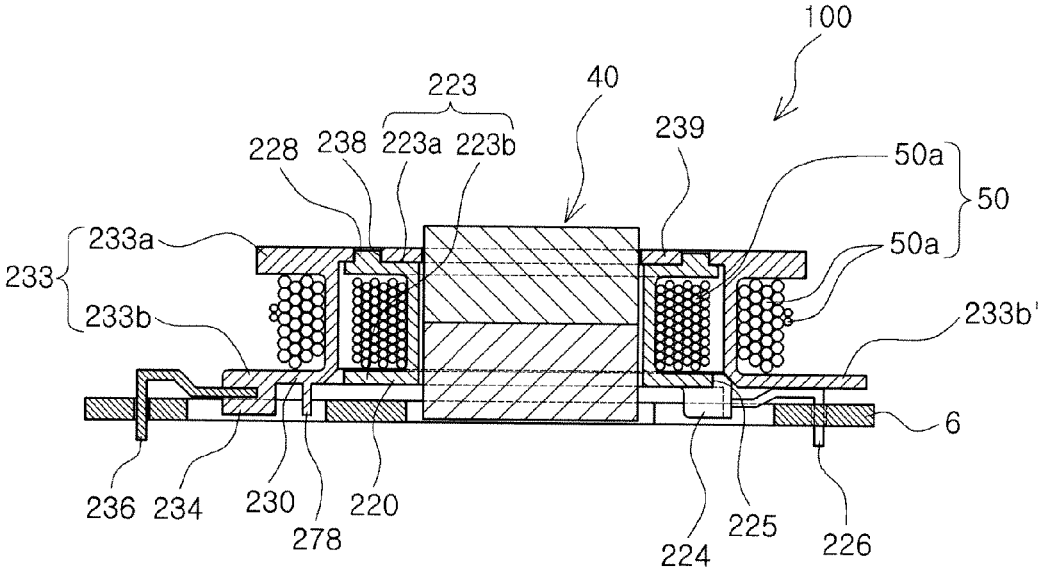
FIG. 3 is a cross-sectional view taken along line D-D' of FIG. 1.

FIG. 1 is a perspective view schematically showing a transformer according to an embodiment of the present invention. FIG. 2 is an exploded perspective view of the transformer shown in FIG. 1. FIG. 3 is a cross-sectional view taken along line D-D' of FIG. 1.

Figure 4:
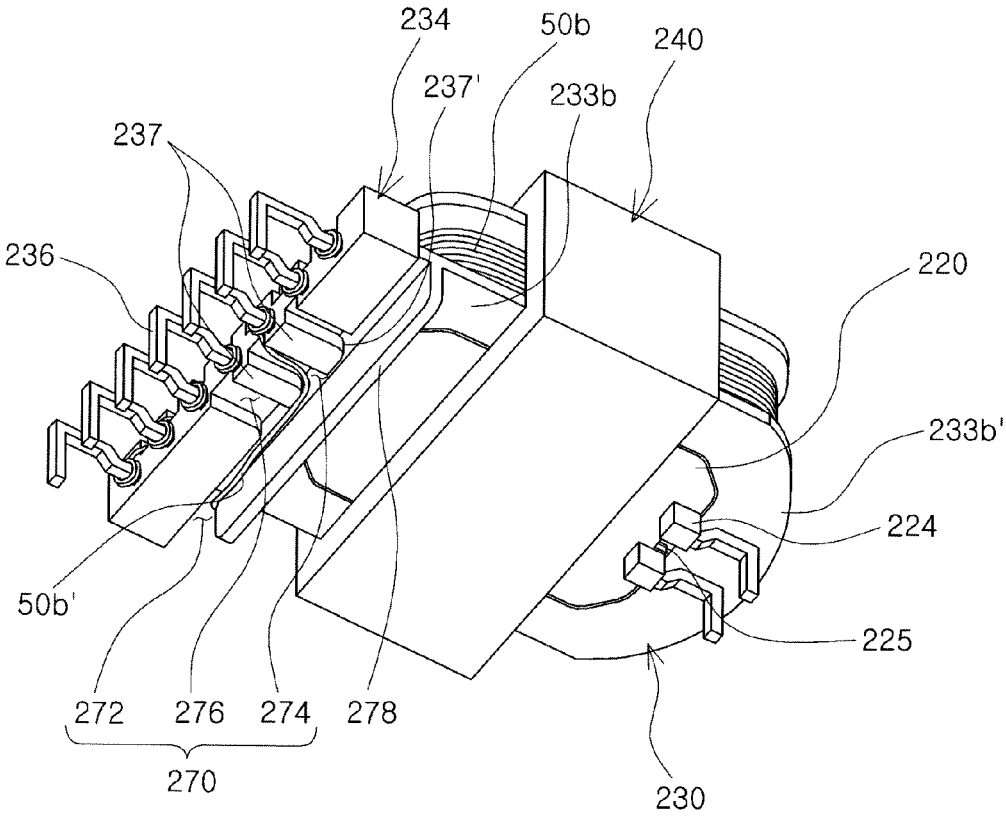
FIG. 4 is a perspective view of a bottom surface of the transformer shown in FIG. 1.
Figure 5:
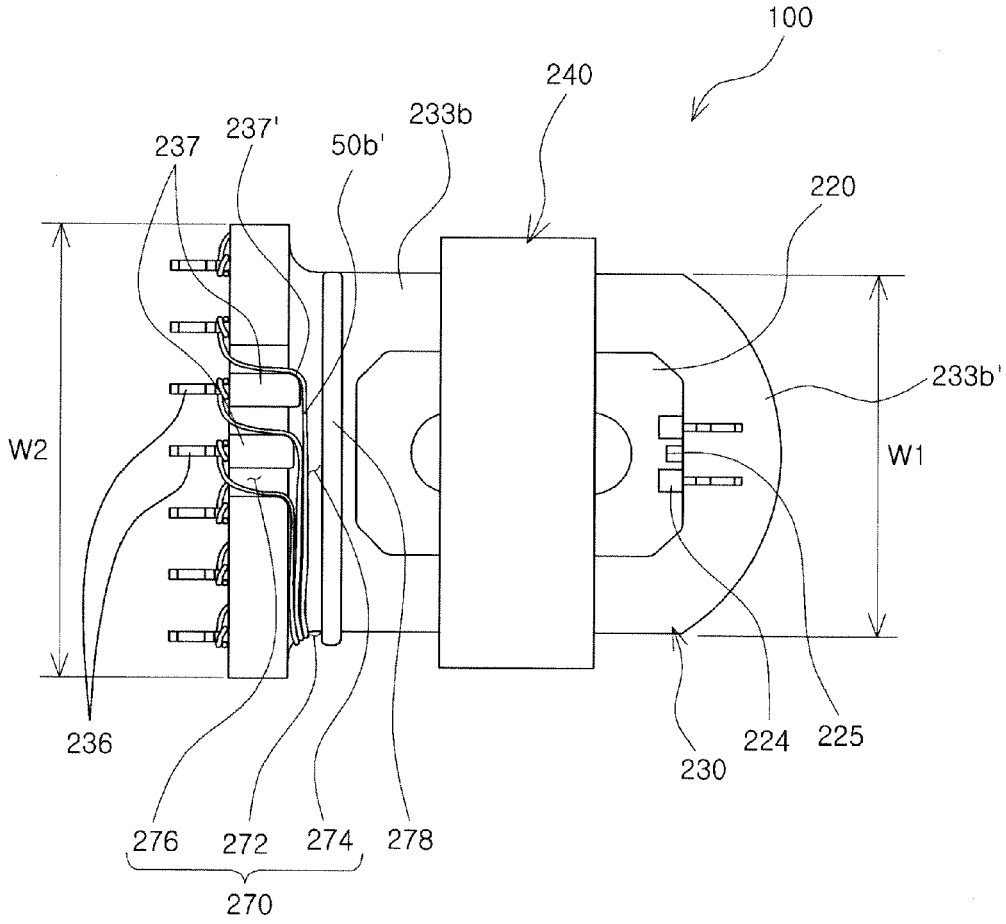
FIG. 5 is a bottom view of the transformer shown in FIG. 1.

FIG. 4 is a perspective view of a bottom surface of the transformer shown in FIG. 1. FIG. 5 is a bottom view of the transformer shown in FIG. 1.

Referring to FIGS. 1 through 5, a transformer 100 according to the embodiment of the present invention includes a bobbin part 210, a coil 50, and a core 40.

The bobbin part 210 includes an outer bobbin 230 and at least one inner bobbin 220.

The inner bobbin 220 includes a pipe shaped body part 222 having a through-hole 221 formed at the center of an inner portion thereof, a flange part 223 extended from both ends of the body part 222 in an outer diameter direction of the body part 222, external connection terminals 226 for electrical and physical connection to the outside, and a terminal connection part 224 having the external connection terminals 226 connected thereto.

The through-hole 221 formed in the inner portion of the body part 222 is used as a path through which a portion of a core 40 to be described below is inserted. The embodiment of the present invention describes a case in which the through-hole 221 has a rectangular cross section by way of example. The cross sectional shape corresponds to a shape of the core 40 inserted into the through-hole 221. In the inner bobbin 220 according to an embodiment of the present invention, the through-hole 221 is not limited to having the above-mentioned shape but may have various shapes corresponding to shapes of the core 40 inserted thereinto.

The flange part 223 is divided into an upper flange part 223*a* and a lower flange part 223*b* according to a formation position thereof. In addition, a space between an outer peripheral surface of the body part 222 and the upper and lower flange parts 223*a* and 223*b* is used as a space around which a coil 50 to be described below is wound. Therefore, the flange part 223 serves to protect the coil 50 from the outside and secure an insulation property between the coil 50 and the outside, simultaneously with supporting the coil 50 wound around the outer peripheral surface of the body part 222 at both sides thereof.

The lower flange part 223*b* of the inner bobbin 220 includes the terminal connection part 224 formed on one side thereof, the terminal connection part 234 having the external connection terminals 226 connected thereto. The terminal connection part 234 protrudes outwardly (that is, downwardly) from one side of the lower flange part 223*b*, and may include at least one lead groove 235 into which a lead wire of the coil 50 wound around the inner bobbin 220 is inserted. The lead wire of the coil 50 may lead to the outside of the inner bobbin 220 through the lead groove 235.

Meanwhile, although the embodiment of the present invention describes a case in which the lead wire of the coil 50 leads to the outside of the inner bobbin 220 using the lead groove 235 by way of example, the present invention is not limited thereto but may be variously applied. For example, the lower flange part 223*b* of the inner bobbin 220 may be formed to have a smaller size than an inner peripheral edge of a through-hole 231 of the outer bobbin 230, whereby the lead wire of the coil 50 may lead to the outside of the inner bobbin 220 using a gap formed between the lower flange part 223*b* and the inner peripheral edge of the through-hole 231.

The external connection terminals 226 may be connected to the terminal connection part 224 such that they protrude from the terminal connection part 234 in the downward direction or the outer diameter direction of the body part 222. In addition, the external connection terminal 226 according to the embodiment of the present invention may support the outer bobbin 230 while having an upper surface contacting a lower surface of a lower flange part 233*b* of the outer bobbin 230, to be described below.

In addition, the inner bobbin 220 according to the embodiment of the present invention is coupled to the outer bobbin 230 to thereby be formed integrally therewith. To this end, the inner bobbin 220 includes at least one fitting protrusion 228 formed on the upper flange part 223*a* thereof. The fitting protrusion 228 is inserted into a fitting hole 238 of the outer bobbin 230. Therefore, the fitting protrusion is formed to correspond a size and a position of the fitting hole 238. A detailed description thereof will be provided in a description of the outer bobbin 230, to be provided below.

The outer bobbin 230 has a similar shape to that of the inner bobbin 220 and has approximately the same thickness as that of the inner bobbin 220; however, the outer bobbin 230 has a size different from that of the inner bobbin 220.

The outer bobbin 230 includes a pipe shaped body part 232 having a through-hole 231 formed at the center of an inner portion thereof, a flange part 233, a terminal connection part 234, and external connection terminals 236, similarly to the inner bobbin 220. Therefore, a detailed description of configurations of the outer bobbin 230 the same as those of the inner bobbin 220 will be omitted and only a detailed description of configurations of the outer bobbin 230 different therefrom will be provided.

The through-hole 231 formed in the inner portion of the body part 232 is used as a space into which the inner bobbin 220 is inserted. Therefore, the through-hole formed in the outer bobbin 230 has a shape corresponding to that of an outer peripheral edge of the flange part 223 of the inner bobbin 220.

In addition, a space formed between an outer peripheral surface of the body part 232 of the outer bobbin 230 and one surface (that is, an inner surface) of a flange part 233 is used as a space around which the coil 50 to be described below is wound.

The lower flange part 233*b* includes the terminal connection part 234 formed at one end thereof and an extension part 233*b*' formed at the other end thereof, the terminal connection part 234 including the external connection terminals 236 connected thereto.

The extension part 233*b*' has a shape in which the lower flange part 233*b* extends outwardly from the other end thereof and increases an area of the other end thereof. In the transformer 100 according to the embodiment of the present invention, when the inner bobbin 220 is coupled to the outer bobbin 230, the external connection terminals 226 of the inner bobbin 220 support the outer bobbin 230 while contacting the lower surface of the lower flange part 233*b* of the outer bobbin 230. In this case, since a distance between the external connection terminals 226 of the inner bobbin 220 and a secondary coil 50*b* wound around the outer bobbin 230 is significantly adjacent to each other, insulation therebetween may be destroyed.

However, the transformer 100 according to the embodiment of the present invention includes the extension part 233*b*' formed at the other end of the lower flange part 233*b* of the outer bobbin 230, whereby an insulation distance and a creepage distance between the external connection terminals 226 of the inner bobbin 220 and the secondary coil 50*b* wound around the outer bobbin 230 may easily be secured.

Therefore, the extension part 233*b*' according to the embodiment of the present invention may be extended outwardly by a distance through which the insulation distance and the creepage distance between the external connection terminals 226 of the inner bobbin 220 and the secondary coil 50*b* wound around the outer bobbin 230 may be secured.

In addition, through the extension part 233*b*', the upper flange part 233*a* and the lower flange part 233*b* may have different areas at the other end of the flange part 233 of the outer bobbin 230.

Meanwhile, in the case in which the other end of the flange part 233 of the outer bobbin 230 is sufficiently extended, such that the insulation distance and creepage distance may be secured even in the case the other end of the lower flange part 233*b* is not extended, the extension part 233*b*' may be omitted.

The terminal connection part 234 may be formed to protrude outwardly from one end of the lower flange part 233*b*. More specifically, the terminal connection part 234 according to the embodiment of the present invention has a long bar shape, in which it protrudes while being extended from the lower flange part 233*b* in an outer diameter direction and a downward direction. Here, each of both distal ends of the terminal connection part 234 having the bar shape further protrudes outwardly from an outer peripheral edge of the lower flange part 233*b*.

Therefore, as shown in FIG. 5, the entire width W2 of the terminal connection part 234 is greater than the entire width W1 of the lower flange part 233*b* of the outer bobbin 230.

The terminal connection part 234 according to the embodiment of the present invention includes a plurality of external connection terminals 236 disposed to be spaced apart from each other by a predetermined interval. The external connection terminals 236 may be respectively connected to the terminal connection part 234 in such a manner as to protrude in the downward direction or the outer diameter direction of the body part 232 from a distal end of the terminal connection part 234.

In addition, the respective external connection terminals 236 may include a plurality of lead grooves 235 formed therebetween and within the terminal connection part 234, the lead grooves 235 guiding the lead wire of the coil 50 to the external connection terminal 236.

Due to the configuration of the terminal connection part 234 as described above, the lead wire of the coil 50 wound around the outer bobbin 230 may be electrically connected to the external connection terminal 236 while passing through the lead groove 235.

Meanwhile, in the transformer 100 according to the embodiment of the present invention, a coil skip part 270 to be described below may be used together with the lead groove 235 in order to guide a lead wire of the secondary coil 50*b* to the external connection terminal 236.

As shown in FIGS. 4 and 5, the transformer 100 according to the embodiment of the present invention includes the coil skip part 270.

The coil skip part 270 provides a route through which a lead wire 50*b*' of the secondary coil 50*b* wound around the outer bobbin 230 is skipped to an outer surface (that is, the lower surface) of the lower flange part 233*b* through the outer peripheral edge of the outer bobbin 230, rather than the terminal connection part 234 and is then connected to the external connection terminal 226.

The coil skip part 270 according to the embodiment of the present invention is formed by a guide block 278 and the terminal connection part 234, and includes a skip groove 272, a traversing route 274, and a guide groove 276.

The guide block 278 is formed on the lower surface of the outer bobbin 230, that is, the lower surface of the lower flange part 233*b*. The guide block 278 is provided in order to provide a path through which the lead wire 50*b*' of the secondary coil 50*b* is disposed on a lower portion of the outer bobbin 230, simultaneously with securing a creepage distance between the external connection terminals 236 of the outer bobbin 230 and a primary coil 50*a* of the inner bobbin 220.

To this end, the guide block 278 according to the embodiment of the present invention is protruded from a space between the terminal connection part 234 and the through-hole 231 and is disposed to traverse the lower surface of the lower flange part 233*b* of the outer bobbin 230 in a direction parallel to the terminal connection part 234.

In addition, at least one of both distal ends of the guide block 278 according to the embodiment of the present invention protrudes outwardly from the lower flange part 233*b* of the outer bobbin 230. Here, a space between one end of the outwardly protruding guide block 278 and one end of the terminal connection part 234 is used as the skip groove 272.

The skip groove 272 is a groove formed by one end of the guide block 278 vertically protruding outwardly from the outer peripheral edge of the lower flange part 233*b*, one end of the terminal connection part 234, and the lower flange part 233*b* provided therebetween, as described above. The skip groove 272 is used as a route through which the lead wire 50*b*' of the secondary coil 50*b* wound around the outer bobbin 230 is skipped to the lower portion of the outer bobbin 230.

Meanwhile, the embodiment of the present invention describes a case in which the guide block 278 and one end of the terminal connection part 234 protrude outwardly of the lower flange part 233*b* to thereby form the skip groove 272 by way of example. However, the present invention is not limited thereto but may be variously changed. For example, grooves having various shapes may be used as long as they are formed on the outer peripheral edge of the lower flange part 233*b*, such as a case in which a groove is formed through the removal of a portion of the lower flange part 233*b* between the guide block 278 and the terminal connection part 234, rather than the protrusion of the guide block 278 and one end of the terminal connection part 234, or the like.

The traversing route 274, which is a path formed between the guide block 278 and the terminal connection part 234, provides a path traversing the lower flange part 233*b*. The traversing route 274 is used as a path through which the lead wire 50*b*' of the secondary coil 50*b* skipped through the skip groove 272 is disposed in a length direction of the terminal connection part 234.

The guide groove 276 is formed to have a groove shape on a lower surface of the terminal connection part 234 and is used as a path through which the lead wire 50*b*' of the secondary coil 50*b* disposed in the traversing route 274 is connected to the external connection terminal 236. That is, the guide groove 276 allows the direction of the lead wire 50*b*' of the secondary coil 50*b* disposed in the traversing route 274 to be changed to a direction in which the external connection terminal 236 is disposed.

To this end, the guide groove 276 is formed to traverses the terminal connection part 234 in a width direction of the terminal connection part 234, such that one end thereof is in communication with the traversing route 274 and the other end thereof is opened to the outside of the terminal connection part 234.

The guide groove 276 may be provided in plural, corresponding to the number of lead wires 50*b*' disposed in the traversing route 274 or the number of external connection terminals 236 having the corresponding lead wires 50*b*' connected thereto, and the plurality of guide grooves 276 may be formed parallel to each other.

Here, the plurality of guide grooves 276 may be divided from each other by a plurality of partition walls 237.

The partition walls 237 may be disposed to be spaced apart from each other by predetermined intervals, and the plurality of the guide grooves 276 may be individual grooves divided by the partition walls 237. Therefore, the lead wires disposed in the traversing route 274 are disposed in the inner portion of the guide grooves 276 while supporting the partition walls 237 (particularly, edge portions).

Figure 6:
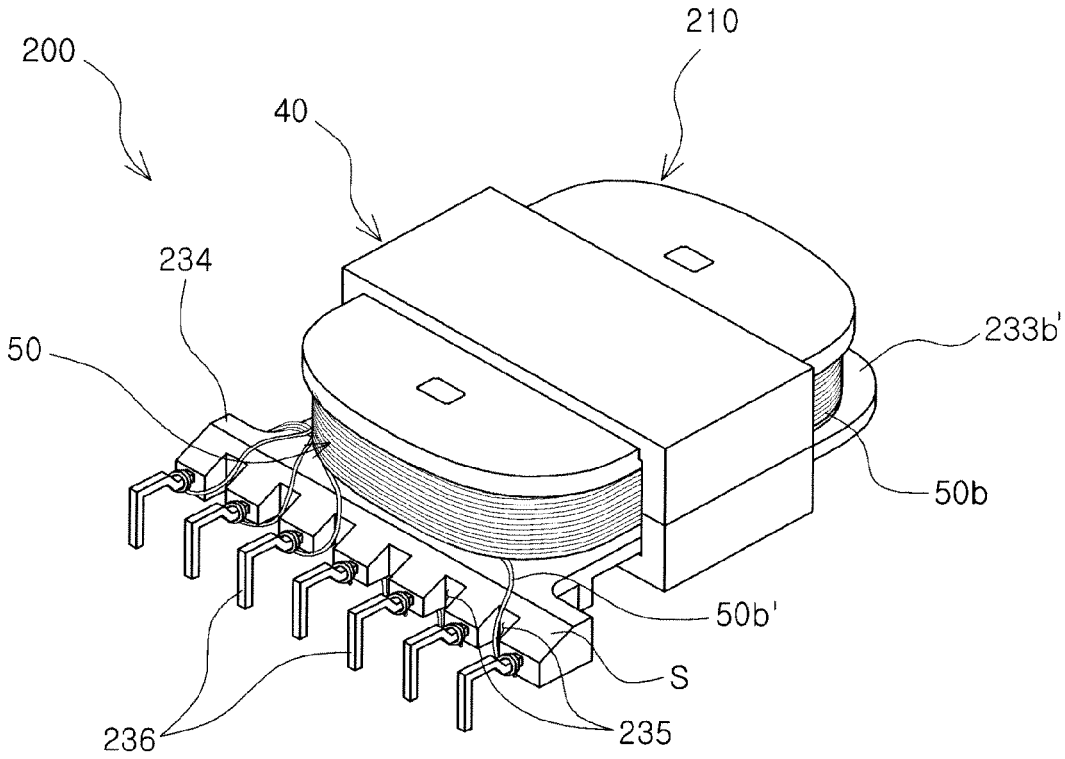
FIG. 6 is a perspective view schematically showing a transformer according to another embodiment of the present invention.

In this configuration, the lead wire 50*b*' contacts the edge portion of the partition wall 237, such that the lead wire 50*b*' may be excessively bent or curved at a contact portion therebetween. Therefore, the partition wall 237 according to the embodiment of the present invention has a chamfer 237' formed at an edge portion thereof directly contacting the lead wire 50'. FIGS. 5 and 6 show a case in which the chamfer 237' has a curved surface by way of example. However, the present invention is not limited thereto but may be variously applied. For example, the chamfer 237' may have an inclined surface.

In addition, the plurality of partition walls 237 according to the embodiment of the present invention may be formed such that the respective partition walls 237 has a different length. More specifically, one ends of the partition walls 237 according to the embodiment of the present invention, contacting the traversing route 274 may partially protrude into the traversing route 274. Here, protrusion distances may be different for each of the partition walls 237.

As shown in FIG. 5, one ends of the partition walls 237 according to the embodiment of the present invention have protrusion distances that become smaller as the partition walls 237 are disposed to be adjacent to the skip groove 272 and that become larger as they are disposed to be away from the skip groove 272.

This configuration of the partition walls 237 is to prevent defects in which, when the number of the lead wires 50*b*' of the coil 50*b* skipped through the skip groove 272 is plural, the skipped lead wires 50*b*' are tangled or twisted to thereby cause the occurrence of a short circuit or the like between the lead wires 50*b*'.

That is, in the transformer according to the embodiment of the present invention, the lead wires 50*b*' supporting the respective partition walls 237 may be disposed at different positions according to the protrusion distances of the partition walls 237. Therefore, even though the plurality of lead wires 50*b*' are skipped through the skip groove 272, the respective lead wires 50*b*' may be disposed parallel to each other without being overlapped with each other within the traversing route 274 to thereby prevent the defects from being generated.

A process of disposing the lead wires 50*b*' of the secondary coil 50*b* in the coil skip part 270 according to the embodiment of the present invention configured as described and connecting the lead wires 50*b*' to the external connection terminals 236 will be described below.

The secondary coil 50*b* wound around the outer bobbin 230 is finally connected to the external connection terminal 236 while the lead wire 50*b*' is wound around the external connection terminal 236. Here, the lead wire 50*b*' of the secondary coil 50*b* may be connected to the external connection terminal 236 while passing through the above-mentioned lead groove 235 or move to the lower surface of the outer bobbin 230 through the coil skip part 270 and then be connected to the external connection terminal 236.

The lead wire 50*b*' lead to the lead groove 235 may be directly connected to the external connection terminal 236.

On the other hand, when the lead wire 50*b*' is connected to the external connection terminal 236 through the coil skip part 270, the lead wire 50*b*' moves to the lower surface of the outer bobbin 230 through the skip groove 272. Then, the lead wire 50*b*' is disposed in the traversing route 274 formed on the lower surface of the outer bobbin 230 and then has a route changed toward the guide groove 276 while supporting the partition wall 237 to thereby be connected to the external connection terminal 236.

In the embodiment of the present invention, the route of the lead wire 50*b*' is changed at an angle approximately perpendicular to the guide groove 276. However, the present invention is not limited thereto. For example, the route of the lead wire 50*b*' may be set by forming the partition wall 237 at various angles, as long as the lead wire 50*b*' may be firmly connected fixedly to the external connection terminal 236 without causing interference with the lead wires 50*b*' of the other coils.

The partition wall 237 according to the embodiment of the present invention is formed such that a sidewall thereof contacting the lead wire 50*b*' is approximately perpendicular to a bottom surface thereof (that is, the lower flange part of the outer bobbin). This configuration of the partition wall 237 is to prevent the lead wire 50*b*' supported by the partition wall 237 from being separated from the guide groove 276.

Therefore, the partition wall 237 according to the embodiment of the present invention is not limited to having the above-mentioned configuration but may have various shapes as long as it is configured to prevent the lead wire 50*b*' supported by the guide groove 276 from being separated from the guide groove 276. For example, a sidewall (or the chamfer) of the partition wall 237 contacting the lead wire 50*b*' may make an acute angle with regard to the bottom surface. In addition, various applications may be made. For example, a step or a groove may be formed in the chamfer 237'

The coil skip part 270 according to the foregoing embodiment of the present invention is provided in consideration of a case in which the secondary coil 50*b* is automatically wound around the outer bobbin 230.

That is, through the configuration of the coil skip part 270 according to the embodiment of the present invention, winding the secondary coil 50*b* around the outer bobbin 230, disposing the lead wire 50*b*' in the traversing route 274 while skipping the lead wire 50*b*' of the secondary coil 50*b* to the lower surface of the outer bobbin 230 through the skip groove 272, and changing the route of the lead wire 50*b*' through the guide groove 276 to thereby lead the lead wire 50*b*' in a direction in which the external connection terminal 236 is formed and then connecting the lead wire 50*b*' to the external connection terminal 236 may be automatically performed through a separate automatic wiring device (not shown).

The transformer 100 according to the embodiment of the present invention includes the coil skip part 270, which is a route through which the lead wire 50*b*' of the secondary coil 50*b* may traverse the outer bobbin 230 from the lower surface of the outer bobbin 230.

Therefore, the lead wires 50*b*' of the secondary coil 50*b* are connected to the external connection terminals 236 while being separately disposed on one surface (that is, the lead groove of the terminal connection part) and the other surface (that is, the coil skip part) of the lower flange part 233*b* in order to prevent an intersection therebetween, whereby the lead wires 50*b*' of the coil 50*b* may be connected to the external connection terminals 236 through various routes, as compared to the transformer according to the related art.

According to the related art, when a plurality of coils are wound around a bobbin, the lead wires of the coil lead to the external connection terminals are disposed to intersect with each other. Therefore, the lead wires may come into contact with each other, thereby causing a short circuit between the coils.

However, the transformer 100 according to the embodiment of the present invention provides a new route through the use of the coil skip part 270 as described above, whereby the lead wires 50*b*' may be connected to the external connection terminals 236 through various routes. Therefore, the intersection or contact between the lead wires 50*b*' may be prevented.

In addition, the outer bobbin 230 according to the embodiment of the present invention includes a support part 239 formed at an upper end of the body part 232 so as to cover a portion of the through-hole 231 toward an inner portion of the through-hole 231. Therefore, the through-hole 231 formed in the lower surface of the outer bobbin 230 has a different cross-sectional area from the through-hole 231 formed in the upper surface thereof.

More specifically, the through-hole 231 formed in the lower surface of the outer bobbin 230 has a cross-sectional area similar to the entire area formed by the outer peripheral edge of the flange part 223 of the inner bobbin 220. In addition, the through-hole 231 formed in the upper surface of the outer bobbin 230 has a cross-sectional area smaller than that of the lower surface described above, due to the support part 239.

As described above, since the outer bobbin 230 includes the support part 239, when the inner bobbin 220 is inserted into the through-hole 231 of the outer bobbin 230, the inner bobbin 220 may be inserted only through the lower surface of the outer bobbin 230.

In addition, the upper flange part 223*a* of the inner bobbin 220 inserted into the through-hole 231 of the outer bobbin 230 may surface-contact the lower surface of the support part 239 of the outer bobbin 230. That is, the inner bobbin 220 is coupled to the outer bobbin 230 while having one end thereof supported by the support part 239, such that the inner bobbin 220 does not protrude upwardly of the outer bobbin 230 or is not separated therefrom.

The support part 239 of the outer bobbin 230 includes at least one fitting hole 238 formed therein, as describe above.

The fitting hole 238 includes the fitting protrusion 228 fitted thereinto. Therefore, the fitting hole 238 is formed in the support part 239 being capable of contacting the upper surface of the upper flange part 223*a* of the inner bobbin 220. More specifically, the fitting hole 238 is formed at a location of the support part 239, into which the fitting protrusion 228 of the inner bobbin 220 may be inserted and fitted when the inner bobbin 220 is coupled to the outer bobbin 230.

The fitting protrusion 228 may be configured to be forcedly fitted into the fitting hole 238 in order to secure coupling force between the inner and outer bobbins 220 and 230. In this case, a cross section of a lower portion of the fitting protrusion 228 may have a size larger than that of the fitting hole 238.

More specifically, the fitting protrusion 228 may have a cross section smaller toward an upper end portion thereof. In addition, the upper end portion of the fitting protrusion 228 may have a cross section smaller than a size of the fitting hole 238 and a lower end portion thereof may have a cross section larger than the size of the fitting hole 238.

Therefore, the upper end portion of the fitting protrusion 228 may easily be inserted into the fitting hole 238. When the fitting protrusion 228 is completely inserted into the fitting hole 238, it is forcedly fitted into the fitting hole 238, whereby the inner and outer bobbins 220 and 230 may be firmly coupled fixedly to each other.

However, the present invention is not limited thereto. The fitting protrusion 228 may be fitted into and fixed to the fitting hole 238 in various forms.

Meanwhile, the bobbin part 210 according to the present embodiment may be configured so that the inner surface of the flange part 223 of the inner bobbin 220 and the inner surface of the flange part 233 of the outer bobbin 230 are disposed on the same plane. Particularly, the lower surface of the upper flange part 223*a* of the inner bobbin 220 and the lower surface of the upper flange part 233*a* of the outer bobbin 230 are disposed on the same plane.

To this end, the upper flange part 233*a* of the outer bobbin 230 according to the present embodiment may have a partially thicker thickness than that of the upper flange part 223*a* of the inner bobbin 220.

More specifically, as shown in FIG. 3, the upper flange part 233*a* of the outer bobbin 230 exposed to the outside of the core 40 has a thickness corresponding to the combined thickness of the support part 239 of the outer bobbin 230 and the upper flange part 223*a* of the inner bobbin 220.

Therefore, the entire thickness of the upper flange part 233*a* of the inner bobbin 220 and the fitting protrusion 228 may be the same as or smaller than the thickness of the upper flange part 233*a* of the outer bobbin 230. However, the present invention is not limited thereto.

Due to this configuration, when the inner and outer bobbins 220 and 230 are coupled to each other, the inner surface of the upper flange part 223*a* of the inner bobbin 220 and the inner surface of the upper flange part 233*a* of the outer bobbin 230 are disposed on the same plane. Likewise, the inner surface of the lower flange part 223*b* of the inner bobbin 220 and the inner surface of the lower flange part 233*b* of the outer bobbin 230 are also disposed on the same plane.

In the bobbin part 210 according to the embodiment of the present invention configured as described above, the external connection terminals 226 included in the inner bobbin 220 and the external connection terminals 236 included in the outer bobbin 230 are disposed to be maximally spaced apart from each other. Therefore, when the inner bobbin 220 is coupled to the outer bobbin 230, the inner bobbin 220 is coupled to the outer bobbin 230 such that a location at which the terminal connection part 224 is formed is positioned in a direction opposed to a location at which the terminal connection part 234 is formed.

Therefore, the external connection terminals 236 of the outer bobbin 230 and the external connection terminals 226 of the inner bobbin 220 are disposed to protrude in opposing directions to each other. Therefore, in the transformer 100 according to the embodiment of the present invention, the external connection terminals 226 of the primary coil 50*a* are sufficiently spaced apart from the external connection terminals 236 of the secondary coil 50*b*, whereby an insulation distance between the primary and secondary coils may easily be secured.

In addition, in the bobbin part 210 according to the embodiment of the present invention, when the inner bobbin 220 is coupled to the outer bobbin 230, an insulation property between the coil 50*a* wound around the inner bobbin 220 and the coil 50*b* wound around the outer bobbin 230 may be secured through the outer bobbin 230. Therefore, the bobbin part 210 according to the embodiment of the present invention has a higher insulation property as compared to a case according to the related art in which an insulating tape is used, such that the coil 50*a* wound around the inner bobbin 220 and the coil 50*b* wound around the outer bobbin 230 may be disposed to be maximally adjacent to each other.

However, in order to secure output characteristics of the transformer 100 or a creepage distance, an outer surface of the primary coil 50*a* may also be spaced apart from the inner peripheral surface of the through-hole 231 of the outer bobbin 230 by a predetermined interval. This may easily be applied by controlling the width of the flange part 223 of the inner bobbin 220 or the turn number of the primary coil 50*a* wound around the inner bobbin.

Further, although the embodiment of the present invention describes a case in which the bobbin part 210 is configured of a single outer bobbin 230 and a single inner bobbin 220 by way of example, the present invention is not limited thereto. That is, a plurality of bobbins may be inserted into the single outer bobbin 230. For example, the bobbin part 210 may be configured in such a manner that a separate bobbin (hereinafter, referred to as an intermediate bobbin) having a similar shape to that of the outer bobbin 230 is inserted into the through-hole 231 of the outer bobbin 230, the inner bobbin 220 is inserted into a through-hole of the intermediate bobbin, and then the core 40 may be inserted into the through-hole 221 of the inner bobbin 220.

In this case, any one of the primary and secondary coils may be selectively wound around the maximum two individual bobbins.

The individual bobbins 220 and 230 of the bobbin part 210 according to the embodiment configured as described above may easily be manufactured by an injection molding method. However, the present invention is not limited thereto. The individual bobbins 220 and 230 may be manufactured by various methods such as a press processing method, or the like. In addition, the individual bobbins 220 and 230 of the bobbin part 210 according to the embodiment of the present invention may be made of an insulating resin material and a material having high heat resistance and high voltage resistance. As a material of the individual bobbins 220 and 230, polyphenylenesulfide (PPS), liquid crystal polyester (LCP), polybutyleneterephthalate (PBT), polyethyleneterephthalate (PET), phenolic resin, or the like, may be used.

The coil 50 includes the primary coil 50*a* and the secondary coil 50*b*.

The primary coil 50*a* is wound around the inner bobbin 220.

Further, the primary coil 50*a* according to the embodiment of the present invention may include a plurality of coils electrically insulated from each other and wound around the single inner bobbin 220. That is, in the transformer 100 according to the embodiment of the present invention, the primary coil 50*a* are configured of the plurality of coils, such that a voltage may be selectively applied to each of the coils and various voltages may be drawn through the secondary coil 50*b* correspondingly.

In this case, two or more external connection terminals 226 may be included in the inner bobbin 220.

As the plurality of coils configuring the primary coil 50*a*, coils having different diameters and turn numbers may be used. In addition, a single wire or a twisted pair of wires formed by twisting several strands may be used as the primary coil 50*a*.

The lead wire of the primary coil 50*a* is connected to the external connection terminal 226 included in the inner bobbin 220.

The secondary coil 50*b* is wound around the outer bobbin 230.

Similarly to the primary coil 50*a*, the secondary coil 50*b* may also include a plurality of coils electrically insulated from each other. In addition, the lead wire 50*b*' of the secondary coil 50*b* is connected to the external connection terminal 236 included in the outer bobbin 230.

Meanwhile, the embodiment of the present invention describes a case in which the primary coil 50*a* is wound around the inner bobbin 220 and the secondary coil 50*b* is wound around the outer bobbin 230 by way of example. However, the present invention is not limited thereto but may be variously applied as long as the desired voltage of a user may be drawn therefrom. For example, the primary coil 50*a* may be wound around the outer bobbin 230 and the secondary coil 50*b* may be wound around the inner bobbin 220.

The core 40 is inserted into the through-hole 221 formed in the inner portion of the inner bobbin 220. The core 40 according to the embodiment of the present invention is configured to include a pair of cores. The pair of cores may be inserted into the through-hole 221 of the inner bobbin 220 to thereby be connected to each other while facing each other. As the core 40, an 'EE' core, an 'EI' core, or the like, may be used.

The core 40 is coupled to the bobbin part 210 to thereby support the lower surfaces of the inner and outer bobbins 220 and 230. Therefore, the inner and outer bobbins 220 and 230 are not separated from each other by the core 40.

The core 40 may be made of Mn—Zn based ferrite having higher permeability, lower loss, higher saturation magnetic flux density, higher stability, and lower production cost, than other materials. However, in an embodiment of the present invention, the shape or the material of the core 40 is not limited.

Meanwhile, although not shown, the bobbin part 210 and the core 40 according to the embodiment of the present invention may include an insulating tape interposed therebetween. The insulating tape may be provided in order to secure an insulation property between the coil 50 wound around the bobbin part 210 and the core 40.

The insulating tape may be interposed between the bobbin part 210 and the core 40 corresponding to the entire inner peripheral surface of the core 40 facing the bobbin part 210 or be partially interposed therebetween only at a portion at which the coil 50 and the core 40 face each other.

In addition, various applications may be made as needed. For example, the insulating tape may also be attached to an outer surface of the core 40.

In the transformer 100 according to the embodiment of the present invention, the external connection terminals 226 and 236 may be seated on a substrate 6 (for example, a printed circuit board) while being inserted into coupling holes 6*a* formed in the substrate.

Therefore, the substrate 6 according to the embodiment of the present invention may include a reception part 6*b* having a through-hole shape corresponding to a shape of the transformer 100. As shown in FIG. 2, when the reception part 6*b* is formed in the substrate 6, the transformer 100 may be mounted on the substrate 6 in the state of being received in the reception part 6*b*.

In this case, the transformer 100 is received in the substrate 6, and the maximum mounting height of electronic components mounted on the substrate 6 may be minimized.

As described above, in the transformer 100 according to the present embodiment, when the inner bobbin 220 is coupled to the outer bobbin 230, it is coupled to the outer bobbin 230 while being supported by the support part 239 of the outer bobbin 230.

In addition, the core 40 is coupled to outer portions of the inner and outer bobbins 220 and 230 coupled to each other to thereby support both of the lower surfaces of the inner and outer bobbins 220 and 230.

In addition, the inner bobbin 220 according to the embodiment of the present invention is fixedly coupled to the outer bobbin 230 while having the fitting protrusion 228 forcedly fitted into the fitting hole 238 of the outer bobbin 230.

Therefore, in the transformer 100 according to the embodiment of the present invention, the inner and outer bobbins 220 and 230 may be significantly easily assembled and coupled to each other and the inner bobbin 220 are not easily separated or does not protrude from the outer bobbin 230 after they are coupled to each other.

Meanwhile, although the embodiment of the present invention describes a case in which the fitting protrusion is formed in the inner bobbin and the fitting hole is formed in the outer bobbin by way of example, the present invention is not limited thereto. That is, the fitting hole may be formed in the inner bobbin and the fitting protrusion may be formed in the outer bobbin, and each of the inner and outer bobbins may include both of the fitting protrusion and the fitting hole.

In addition, the fitting protrusion may have a hook shape in order to increase adhesion between the inner and outer bobbins. In this case, a hook part extended in the outer diameter direction from the fitting protrusion may be configured to be hooked on an upper surface of the support part of the outer bobbin.

FIG. 6 is a perspective view schematically showing a transformer according to another embodiment of the present invention. A transformer 200 according to the present embodiment has a similar configuration to that of the transformer 100 (See FIG. 1) according to the above-mentioned embodiment and is different therefrom only in a configuration of the terminal connection part 234 of the outer bobbin 230. Therefore, a detailed description of components configured identically to these of the above-mentioned embodiment will be omitted, and a configuration of the terminal connection part 234 of the outer bobbin 230 will be mainly described.

Referring to FIG. 6, the terminal connection part 234 of the outer bobbin 230 according to the embodiment of the present invention has an inclined surface S formed by chamfering a surface extended from the inner surface of the lower flange part 233*b* to the terminal connection part 234. In addition, the respective lead grooves 235 disposed between external connection terminals 236 are formed to vertically penetrate through the terminal connection part 234 and have wider widths than those of the lead grooves 235 (See FIG. 2) according to the foregoing embodiment.

The terminal connection part 234 is formed as described above, whereby the coil 50*b* wound around the outer bobbin 230 may easily be connected to the external connection terminal 236 along the inclined surface S of the terminal connection part 234. In addition, the lead wires 50*b*' are connected to the external connection terminals 236 while passing through the lead grooves 235 having the wide width.

Due to the structure, in the transformer 200 according to the embodiment of the present invention, when the lead wires 50*b*' are bent at the terminal connection part 234, edges of the lead grooves 235, or the like, physical fatigue applied to the bent portions may be minimized.

Figure 7A:
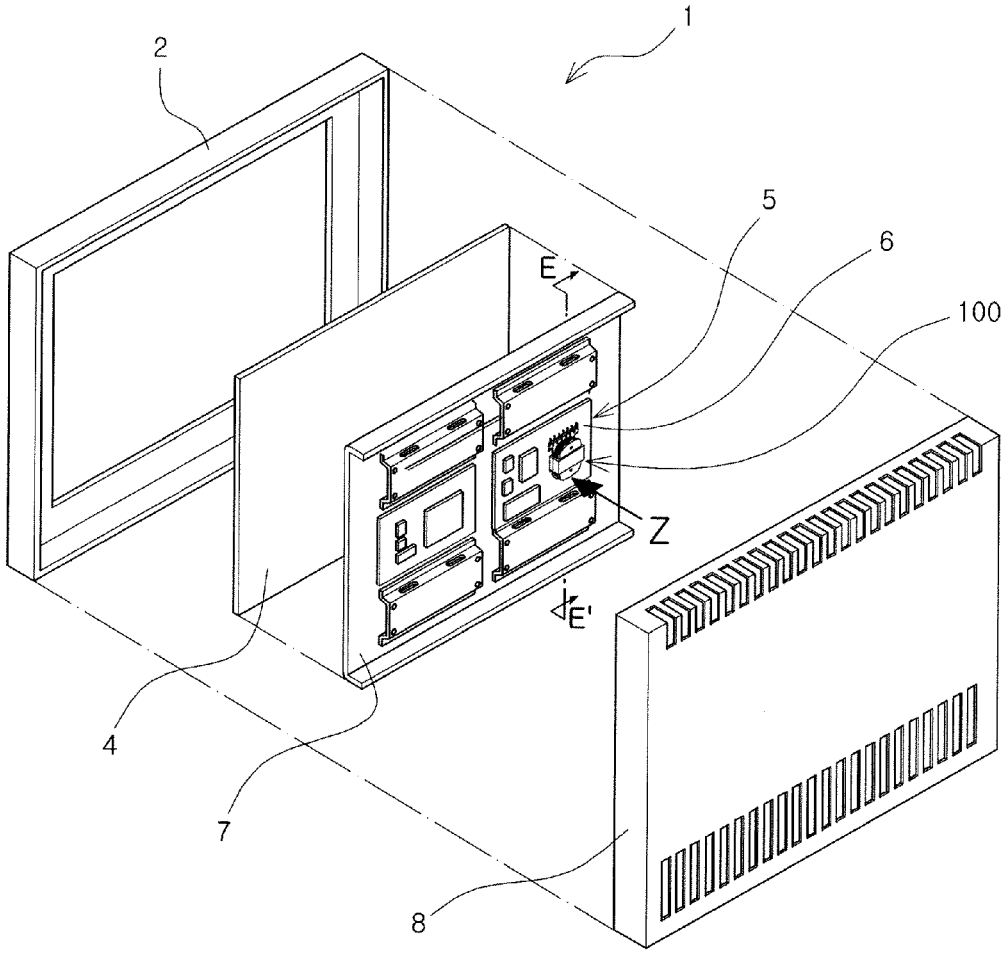
FIG. 7A is an exploded perspective view schematically showing a flat panel display device according to an embodiment of the present invention.
Figure 7B:
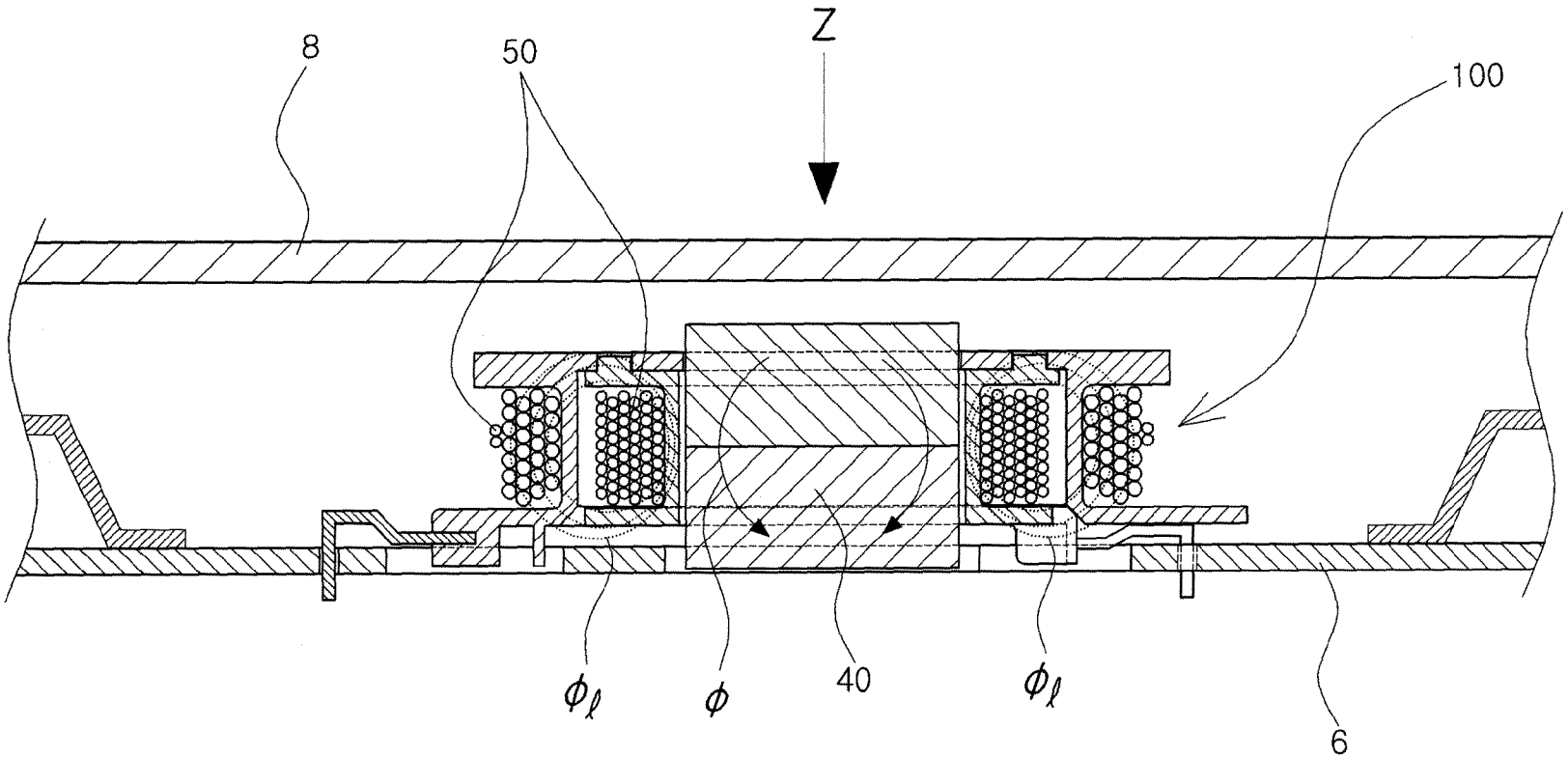
FIG. 7B is a cross-sectional view taken along line E-E' of FIG. 7A.

FIG. 7A is an exploded perspective view schematically showing a flat panel display device according to an embodiment of the present invention. FIG. 7B is a cross-sectional view taken along line E-E' of FIG. 7A.

First referring to FIG. 7A, a flat panel display device 1 according to an embodiment of the present invention may include a display panel 4, a switching mode power supply (SMPS) 5 having the transformer 100 mounted thereon, and covers 2 and 8.

The covers 2 and 8 may include a front cover 2 and a back cover 8 and may be coupled to each other to thereby form a space therebetween.

The display panel 4 is disposed in an internal space formed by the covers 2 and 8. As the display panel, various flat panel display panels such as a liquid crystal display (LCD), a plasma display panel (PDP), an organic light emitting diode (OLED), and the like, may be used.

The SMPS 5 provides power to the display panel 4. The SMPS 5 may be formed by mounting a plurality of electronic components on a printed circuit board 6 thereof and particularly, may include at least one of the transformers 100 and 200 according to the foregoing embodiments mounted thereon. The embodiment of the present invention describes a case in which the SMPS includes the transformer 100 of FIG. 1 by way of example.

The SMPS 5 may be fixed to a chassis 7, and be disposed and fixed in the internal space formed by the covers 2 and 8 together with the display panel 4.

As shown in FIG. 7B, in the transformer 100 mounted on the SMPS 5, the coil 50 is wound in a direction parallel to the printed circuit board 6. In addition, when viewed from a plane of the printed circuit board 6 (a Z direction), the coil 50 is wound clockwise or counterclockwise. Further, a portion (an upper surface) of the core 40 forms a magnetic path while being parallel to the back cover 8.

Therefore, in the transformer 100 according to the embodiment of the present invention, as shown in FIGS. 7A and 7B, a magnetic path of a majority of magnetic flux $\phi$ formed between the back cover 8 and the transformer 100 among a magnetic field generated by the coil 50 is formed in the core 40, whereby the formation of leakage magnetic flux $\phi_1$ between the back cover and the transformer 100 may be minimized.

That is, the transformer 100 according to the embodiment of the present invention is configured such that the coil 50 is wound in a direction parallel to the printed circuit board 6, whereby a magnetic path of the leakage magnetic flux $\phi_1$ is partially formed to be small, without being entirely formed over a space between the transformer 100 and the back cover 8 as in the case according to the related art.

Therefore, even though the transformer 100 according to the embodiment of the present invention does not include a separate shielding device (for example, a shielding shield, or the like) on an outer portion thereof, the generation of interference between the magnetic flux $\phi_1$ and the back cover 8 made of a metal material may be minimized.

Therefore, even though the transformer 100 is mounted in a thin electronic device such as the flat panel display device 1, such that the back cover 8 and the transformer 100 have a significantly narrow space therebetween, the generation of noise due to vibrations of the back cover 8 may be prevented.

The transformer disclosed in the embodiments of the present invention is configured to be appropriate for an automated manufacturing method therefor.

That is, the transformer according to the embodiment of the present invention is completed by individually winding the coils around the inner and outer bobbins, respectively, coupling the inner and outer bobbins to each other, and then coupling the core thereto.

As described above, the transformer according to the embodiment of the present invention is configured such that each of the coils may be wound in a state in which the inner and outer bobbin are separated from each other, in order to easily automatically wind the primary coil and the secondary coil. Here, the coils may be wound by a separate automatic winding device.

In addition, after the winding of the coils is completed, the inner and outer bobbins may be supported by the support part and easily coupled to each other. In addition, the fitting protrusion of the inner bobbin is fitted into the fitting hole of the outer bobbin, whereby the inner bobbin is not easily separated or does not protrude from the outer bobbin after the coupling therebetween is completed. Therefore, in the transformer according to the embodiment of the present invention, coupling the inner and outer bobbins to each other may be automatically performed through a separate device.

As described above, the majority of a process of manufacturing the transformer according to the present invention may be automated. Therefore, a cost and time required for manufacturing the transformer may be significantly minimized.

In addition, the transformer according to the present invention includes the coil skip part, which is a route through which the lead wire of the coil traverses the bobbin from the lower surface of the bobbin. That is, in the transformer according to the present invention, the coils may be connected to the external connection terminals through the coil skip part as well as the lead grooves.

Therefore, the lead wires of the coil may be connected to the external connection terminals through more routes, whereby the generation of a short circuit due to the contact between the lead wires may be prevented.

In addition, the transformer according to the present invention has a reduced thickness. Therefore, the transformer may easily be used in various thin display devices.

Meanwhile, the transformer and the flat panel display device including the same according to the embodiments of the present invention described above are not limited to the embodiments but may be variously applied. That is, various configurations may be applied as long as couping force between the inner and outer bobbins may be secured. For example, at least one of the upper flange part of the inner bobbin and the support part of the outer bobbin includes at least one fitting protrusion protruding therefrom and the other thereof includes a fitting groove formed to correspond the fitting protrusion and having the fitting protrusion coupled thereto.

In addition, the embodiments describe a case in which the individual bobbins have an approximately rectangular parallelepiped shape. However, the present invention is not limited thereto. The individual bobbins may have various shapes, such as a cylindrical shape, or the like, as long as a desired voltage may be drawn therefrom.

In addition, although the present embodiment describes the transformer used in the display device by way of example, the present invention is not limited but may be widely applied to a thin electronic device including the transformer.

As set forth above, the transformer according to the embodiments of the present invention has a structure in which a plurality of individually divided bobbins (for example, the inner and outer bobbins) are included, and these bobbins are coupled to each other. Therefore, the transformer may be completed by winding the coils around the individual bobbins, respectively, and then coupling the individual bobbins to each other. Therefore, a production process may be automated, whereby a cost and time required for manufacturing the transformer may be minimized.

In addition, with the transformer according to the embodiments of the present invention, when the inner bobbin and the outer bobbin are coupled to each other, they are coupled to each other in such a manner that the inner bobbin is received in the outer bobbin. Therefore, the transformer has an entirely flat thin shape, whereby the transformer may easily be used in a thin display device, or the like.

Further, with the transformer according to the embodiments of the present invention, when the inner bobbin and the outer bobbin are coupled to each other, the inner bobbin is coupled to the outer bobbin while being supported by the support part formed so as to cover the through-hole of the outer bobbin. In this configuration, the fitting protrusion formed at the flange part is fitted into the fitting hole formed in the support part of the outer bobbin. Therefore, the inner bobbin may easily be coupled to the outer bobbin, and the inner bobbin is not easily separated from the outer bobbin after the coupling therebetween is completed.

In addition, the transformer according to the embodiments of the present invention includes the coil skip part, which is a path through which the lead wire of the secondary coil traverses the bobbin from the lower surface of the bobbin. That is, in the transformer according to the embodiments of the present invention, the coils may be connected to the external connection terminals through the coil skip part as well as the lead grooves.

Therefore, the lead wires of the coil may be connected to the external connection terminals through more various paths, whereby the generation of a short circuit due to the contact between the lead wires may be prevented.

In addition, when the transformer according to the embodiments of the present invention is mounted on the substrate, the coil of the transformer is maintained in the state of being wound parallel to the substrate. When the coil is wound parallel to the substrate as described above, interference between the leakage magnetic flux generated from the transformer and the outside (for example, the back cover) may be minimized.

Therefore, even though the transformer is mounted in the thin display device, the generation of interference between the leakage magnetic flux generated from the transformer and the back cover may be minimized. Therefore, a phenomenon in which noise is generated in the display device by the transformer may be prevented. Therefore, the transformer may be easily used in thin devices.

While the present invention has been shown and described in connection with the embodiments, it will be apparent to those skilled in the art that modifications and variations can be made without departing from the spirit and scope of the invention as defined by the appended claims.

What is claimed is:

1. A transformer comprising:

a bobbin part including inner and outer bobbins each including a pipe shaped body part having a though-hole disposed in an inner portion thereof and a flange part protruding outwardly from both ends of the body part;

coils respectively wound around the inner and outer bobbins; and a core electromagnetically coupled to the coils to thereby form a magnetic path, wherein the outer bobbin includes a support part disposed at the flange part disposed at an upper end of the body part of the outer bobbin so as to cover a portion of the through-hole, and the inner bobbin is coupled to the outer bobbin while having one end supported by the support part, wherein each of the inner and outer bobbins includes external connection terminals connected to a first end of a lower flange part disposed at a lower end of the body part thereof, wherein the inner and outer bobbins are coupled to each other such that the external connection terminals of the inner bobbin and the external connection terminals of the outer bobbin are disposed in opposing directions, wherein the external connection terminals of the inner bobbin support the outer bobbin while having an upper surface contacting a lower surface of the lower flange part of the outer bobbin, and wherein the outer bobbin includes an extension part extending outwardly from a second end of the lower flange part contacting the external connection terminals of the inner bobbin, and allowing for an increase in an area of the lower flange part.

2. The transformer of claim 1, wherein the through-hole in an upper end portion of the outer bobbin has a cross-sectional area different from that of the through-hole in a lower end portion of the outer bobbin, due to the support part.

3. The transformer of claim 1, wherein the inner bobbin includes at least one fitting protrusion protruding from an upper surface of the flange part disposed at the upper end of the body part thereof.

4. The transformer of claim 3, wherein the outer bobbin includes at least one fitting hole disposed in the support part, and the inner bobbin is coupled to the outer bobbin while having the fitting protrusion inserted into the fitting hole.

5. The transformer of claim 4, wherein the fitting protrusion is forcedly fitted into the fitting hole, such that the inner bobbin is fixedly coupled to the outer bobbin.

6. The transformer of claim 1, wherein an inner surface of the flange part of the inner bobbin and an inner surface of the flange part of the outer bobbin are disposed on the same plane.

7. The transformer of claim 1, wherein at least one of an upper surface of the flange part of the inner bobbin and a lower surface of the support part of the outer bobbin includes at least one fitting protrusion protruding therefrom, and the other thereof includes a fitting groove disposed to correspond to the fitting protrusion and having the fitting protrusion fitted thereinto.

8. The transformer of claim 1, wherein the outer bobbin includes a coil skip part, which is a route through which lead wires of the coil wound around the body part are skipped to a lower surface of the flange part through an outer peripheral edge of the flange part and connected to the external connection terminals.

9. A transformer comprising:

a bobbin part including inner and outer bobbins each including a pipe shaped body part having a though-hole disposed in an inner portion thereof and a flange part protruding outwardly from both ends of the body part;

coils respectively wound around the inner and outer bobbins; and a core electromagnetically coupled to the coils to thereby form a magnetic path, wherein the outer bobbin includes a support part disposed at the flange part disposed at an upper end of the body part of the outer bobbin so as to cover a portion of the through-hole, and the inner bobbin is coupled to the outer bobbin while having one end supported by the support part, wherein each of the inner and outer bobbins includes external connection terminals connected to one end of a lower flange part disposed at a lower end of the body part thereof, wherein the outer bobbin includes a coil skip part, which is a route through which lead wires of the coil wound around the body part are skipped to a lower surface of the flange part through an outer peripheral edge of the flange part and connected to the external connection terminals, and wherein the coil skip part includes:

a skip groove, which is a route through which the lead wires of the coil wound around the body part are transferred to the lower surface of the flange part; and a traversing route, which is a route disposed such that the lead wires skipped through the skip groove traverse the lower surface of the flange part.

10. The transformer of claim 9, wherein the outer bobbin includes a terminal connection part protruding outwardly from one end of the lower flange part disposed on the lower end of the body part thereof and having the external connection terminals connected thereto.

11. The transformer of claim 10, wherein the coil skip part is a route disposed between the terminal connection part and a guide block protruding from the lower surface of the lower flange part in parallel with the terminal connection part.

12. The transformer of claim 11, wherein the guide block has one end protruding outwardly from an outer peripheral edge of the lower flange part, and the skip groove is a groove disposed by the one end of the guide block, the terminal connection part, and the lower flange part.

13. The transformer of claim 11, wherein the terminal connection part includes a plurality of lead grooves disposed between the external connection terminals, and the lead wires of the coil are provided in plural and connected to the external connection terminals while passing through the skip groove or the lead groove.

14. The transformer of claim 10, wherein the coil skip part further includes at least one guide groove disposed to have a groove shape in a lower surface of the terminal connection part to thereby allow a direction of lead wires disposed in the traversing route to be changed to a direction in which the external connection terminals are disposed.

15. The transformer of claim 14, wherein the at least one guide groove includes a plurality of guide grooves divided by a plurality partition walls, and at least one of the plurality of partition walls has one end protruding into the traversing route.

16. The transformer of claim 15, wherein the partition walls have different protrusion distances protruding into the traversing route.

17. The transformer of claim 15, wherein the partition walls have protrusion distances protruding into the traversing path that become smaller as the partition walls are disposed to be adjacent to the skip groove.

18. The transformer of claim 15, wherein the partition walls include chamfers disposed at edge parts thereof contacting the lead wires.

19. The transformer of claim 15, wherein the partition walls make a right angle or an acute angle with a bottom surface thereof at edge parts thereof contacting the lead wires.

20. A transformer comprising:

a bobbin part including a plurality of bobbins each including a pipe shaped body part having a though-hole disposed in an inner portion thereof and a flange part protruding outwardly from both ends of the body part;

external connection terminals connected to a first end of the flange part of at least one of the plurality of bobbins; and at least one coil wound around a space between an outer peripheral surface of the body part and one surface of the flange part, wherein lead wires of the coil are connected to the external connection terminals while being separately disposed on one surface and the other surface of the flange part in order to prevent an intersection therebetween, wherein the plurality of bobbins includes inner and outer bobbins coupled to each other such that external connection terminals of the inner bobbin and external connection terminals of the outer bobbin are disposed in opposing directions, wherein the external connection terminals of the inner bobbin support the outer bobbin while having an upper surface contacting a lower surface of the lower flange part of the outer bobbin, and wherein the outer bobbin includes an extension part extending outwardly from a second end of the lower flange part contacting the external connection terminals of the inner bobbin, and allowing for an increase in an area of the lower flange part.

21. The transformer of claim 20, wherein the bobbin part includes:

the outer bobbin includes a support part disposed at any one end of the body part so as to cover a portion of the through-hole; and the inner bobbin is inserted into the through-hole of the outer bobbin and coupled to the outer bobbin while having one end surface-contacting the support part.

22. A flat panel display device comprising:

a switching mode power supply including at least one transformer of claim 1 mounted on a substrate thereof;

a display panel receiving power from the switching mode power supply; and a cover protecting the display panel and the switching mode power supply.

23. The flat panel display device of claim 22, wherein coils of the transformer are wound so as to be parallel to the substrate of the switching mode power supply.

24. The flat panel display device of claim 22, wherein the substrate of the switching mode power supply includes a through-hole shaped reception part disposed therein, and the transformer is received in the reception part and mounted on the substrate.

25. The transformer of claim 1, wherein the extension part of the outer bobbin extends outwardly from the second end of the lower flange part in a direction perpendicular to an axis of rotational symmetry of the pipe shaped body part of the outer bobbin.

26. The transformer of claim 20, wherein the extension part of the outer bobbin extends outwardly from the second end of the lower flange part in a direction perpendicular to an axis of rotational symmetry of the pipe shaped body part of the outer bobbin.

* * * * *